US007918174B2

(12) United States Patent
Ahn et al.

(10) Patent No.: US 7,918,174 B2
(45) Date of Patent: Apr. 5, 2011

(54) ANTI-SLOSHING DEVICE IN MOON-POOL

(75) Inventors: Young-Kyu Ahn, Gyeongsangnam-do (KR); Hong-Su Kim, Gyeongsangnam-do (KR); Seong-Soo Kim, Gyeongsangnam-do (KR); Jong-Jin Park, Gyeongsangnam-do (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 157 days.

(21) Appl. No.: 12/090,070

(22) PCT Filed: Apr. 19, 2007

(86) PCT No.: PCT/KR2007/001917

§ 371 (c)(1),
(2), (4) Date: Apr. 11, 2008

(87) PCT Pub. No.: WO2007/132985

PCT Pub. Date: Nov. 22, 2007

(65) Prior Publication Data

US 2009/0151613 A1 Jun. 18, 2009

(30) Foreign Application Priority Data

May 11, 2006 (KR) ..... 10-2006-0042169

(51) Int. Cl.

| | |
|---|---|
| ***B63B 1/32*** | (2006.01) |
| ***B63B 1/40*** | (2006.01) |
| ***B63B 3/00*** | (2006.01) |
| ***B63B 35/00*** | (2006.01) |
| ***B63B 35/44*** | (2006.01) |
| ***B63B 39/06*** | (2006.01) |

(52) U.S. Cl. ..... 114/65 R; 114/121; 114/264

(58) Field of Classification Search ..... 114/65 R, 114/121, 126, 230.1, 230.12–230.14, 264, 114/265; 441/3–5; 405/195.1–209, 224–224.4
See application file for complete search history.

(56) References Cited

U.S. PATENT DOCUMENTS 6,220,194 B1 * 4/2001 Kjersem ..... 114/121
(Continued)

FOREIGN PATENT DOCUMENTS

GB 2356174 A * 5/2001
(Continued)

OTHER PUBLICATIONS

International Search Report for the Corresponding International Patent Application No. PCT/KR2007/001917.

(Continued)

*Primary Examiner* — Ajay Vasudeva
(74) *Attorney, Agent, or Firm* — Locke Lord Bissell & Liddell LLP

(57) ABSTRACT

An anti-sloshing moon pool structure is disclosed. The anti-sloshing moon pool structure of the present invention includes moon pool plates (112, 114 and 116), which are provided on a bow-side wall (401), a stern-side wall (403) and opposite sidewalls (405) of a moon pool (100), and a moon pool bottom block (130), which is provided on a bow-side lower edge (407) of the moon pool (100). The moon pool plates and the moon pool bottom block have protruding lengths within which they do not interfere with a maximum working area. Upper steps (112*a*, 112*b*, 114*a*, 114*b*, 116*a*, 116*a*-1, 116*b* and 116*b*-1) of the moon pool plates are disposed such that, when a ship is in a working position, they are lower than the free surface of the seawater, and lower steps (112*c*, 112*d*, 116*c* and 116*d*) of the moon pool plates are disposed such that, when the ship runs, they are lower than the free surface of the seawater.

8 Claims, 7 Drawing Sheets

U.S. PATENT DOCUMENTS

| | | | |
|---|---|---|---|
| 6,543,376 | B1 | 4/2003 | Breivik et al. |
| 6,561,112 | B1 | 5/2003 | Benson et al. |

FOREIGN PATENT DOCUMENTS

| | | | | |
|---|---|---|---|---|
| JP | 52001886 | A | | 8/1977 |
| JP | 53 060092 | A1 | | 5/1978 |
| JP | 60169088 | | | 9/1985 |
| JP | 60169088 | U | | 11/1985 |
| JP | 62279185 | A | * | 12/1987 |
| JP | 08119190 | A | * | 5/1996 |
| JP | 2001 106170 | A1 | | 4/2001 |
| JP | 2001106170 | A | | 4/2001 |
| JP | 2005-199938 | A1 | | 7/2005 |
| JP | 2005199938 | A | * | 7/2005 |

OTHER PUBLICATIONS

International Search Report of corresponding International Patent Application No. PCT/KR2007/001917, mailed Aug. 10, 2007.

English language translation of Office Action received from the Japanese Patent Office, and English language translations of the abstract of the patents cited therein, for corresponding Japanese Patent Application No. 2008-528967, dated Aug. 25, 2010.

* cited by examiner

P–P

Q–Q

ANTI-SLOSHING DEVICE IN MOON-POOL

The present application claims priority as a 35 U.S.C. §371 National stage filing of International Patent Application No. PCT/KR2007/001917, filed Apr. 19, 2007, which claims priority to Korean Patent Application No. 10-2006-0042169, filed May 11, 2006, the contents of all of which are incorporated herein by reference in their entirety.

TECHNICAL FIELD

The present invention relates to a ship having an anti-sloshing moon pool structure.

BACKGROUND ART

According to rapid international industrialization and the development of technology, the usage of the earth's resources, such as oil, has increased. Thus, from a global viewpoint, the stable production and supply of oil has arisen as a very important issue.

For this reason, interest in the development of small marginal oil fields or deep-sea oil fields, which have been disregarded because of their low potential profitability, has increased. Therefore, with the development of offshore drilling techniques, drill ships having drilling equipment suitable for development of such undersea oil fields have been proposed and developed.

In a conventional oil drilling technique, a rig ship or a fixed type platform, which can be moved only by tugboats and is anchored at a position on the sea using mooring apparatuses to conduct an oil drilling operation, has been mainly used.

However, recently, drill ships, which are provided with advanced drilling equipment and have structures similar to typical ships such that they are able to make voyages under their own power, have been developed and used for undersea oil drilling.

To develop small marginal fields, the drill ship is constructed such that it can move under its own power without using tugboats, in consideration of working conditions in which the drill ship must frequently change its stationary position. Therefore, in the drill ship, which is designed such that it can move under its own power, superior traveling performance must be regarded as an important point of the drill ship.

Meanwhile, a moon pool, which is relatively large, and through which drilling pipes are moved to the bottom of the sea, is formed through the drill ship in a central portion thereof. The moon pool is indispensable for the function of the drill ship but becomes a weak point in view of the anchoring of the ship, the voyage stability and the voyage performance of the ship.

Particularly, in a conventional drill ship, due to a sloshing phenomenon, which is induced by relative movement between seawater in the moon pool and seawater outside the ship, when the drill ship runs, resistance is increased, the velocity thereof is reduced, power consumption is increased, fuel consumption is increased, and the ship hull is damaged.

Furthermore, in the case of the conventional drill ship, seawater may overflow onto the ship due to the motion of seawater in the moon pool, with the result that the safety and work efficiency of workers are reduced.

DISCLOSURE

Technical Problem

Accordingly, the present invention has been made keeping in mind the above problems occurring in the prior art, and an object of the present invention is to provide an anti-sloshing moon pool structure which disperses and absorbs the kinetic energy of seawater in a moon pool of a ship, thus mitigating sloshing and overflowing phenomena occurring in the moon pool, and minimizing vortexes generated in the moon pool, thereby increasing the potential velocity of the ship.

Technical Solution

In order to accomplish the above object, the present invention provides an anti-sloshing moon pool structure, including: a plurality of moon pool plates perpendicularly provided on a bow-side wall, a stern-side wall and opposite sidewalls of inner walls of a moon pool; and a moon pool bottom block provided on a bow-side lower edge of the inner walls of the moon pool in a direction oriented toward a center of the moon pool, wherein the moon pool plates and the moon pool bottom block have protruding lengths within which the moon pool plates and the moon pool bottom block do not interfere with a maximum working area, a plurality of upper steps of the moon pool plates is disposed such that, when a ship is in a working position, the upper steps are lower than the free surface of the seawater, and a plurality of lower steps of the moon pool plates is disposed such that, when the ship runs, the lower steps are lower than the free surface of the seawater.

Preferably, in the moon pool plates, the protruding length of each bow-side moon pool plate may be greater than the protruding length of each stern-side moon pool plate. Furthermore, in the sidewall moon pool plates, the protruding length of each stern-side upper step may be less than the protruding length of each of the bow-side upper steps and the bow-side lower steps.

In addition, preferably, the number of layers or steps of the bow-side moon pool plates may be greater than the number of steps of the stern-side moon pool plates, and the number of steps of the stern parts of the sidewall moon pool plates may be less than that of the bow parts of the sidewall moon pool plates.

As well, preferably, the protruding lengths of the moon pool plates may be equal to or similar to each other between layers, or, alternatively, the protruding lengths of the moon pool plates may be reduced from the top of the ship to the bottom of the ship.

Moreover, the anti-sloshing moon pool structure may further include a plurality of moon pool plate supports, which are provided in the moon pool plates to fasten the moon pool plates to the inner walls of the moon pool.

Preferably, moon pool plate holes may be formed through the moon pool plates to mitigate the force of fluid striking the moon pool.

Furthermore, the protruding length of the moon pool bottom block may be greater than 0% of the longitudinal length of the moon pool and 20% or less of the longitudinal length of the moon pool.

In addition, the height of the moon pool bottom block may be equal to the height of the double-ply bottom of the ship. Here, the term "height of the double-ply bottom" means the distance between an outer panel and an inner panel of the double ship body. Thanks to the structure such that the height of the moon pool bottom block is the same as that of the double-ply bottom of the ship, the workability and productivity, when constructing the ship, are enhanced.

Advantageous Effects

The anti-sloshing moon pool structure according to the present invention disperses and absorbs the kinetic energy of seawater in a moon pool of a ship, thus mitigating sloshing and overflowing phenomena occurring in the moon pool. Furthermore, the anti-sloshing moon pool structure minimizes vortexes generated in the moon pool, so that there is an advantage in that, when the ship runs, the velocity of the ship is increased.

DESCRIPTION OF THE ELEMENTS IN THE DRAWINGS

| | | | |
|---|---|---|---|
| 100 | moon pool | 102 | bow part |
| 104 | stern part | 112, 212 | bow-side moon pool plate |
| 114, 214 | stern-side moon pool plate | | |
| 116, 216 | sidewall moon pool plate | | |
| 130 | moon pool bottom block | 150 | moon pool plate support |
| 401 | bow-side wall | 403 | stern-side wall |
| 405 | opposite sidewalls | 407 | bow-side lower edge |

BEST MODE

Hereinafter, preferred embodiments of the present invention will be described in detail with reference to the attached drawings.

First Embodiment

Figure 1:
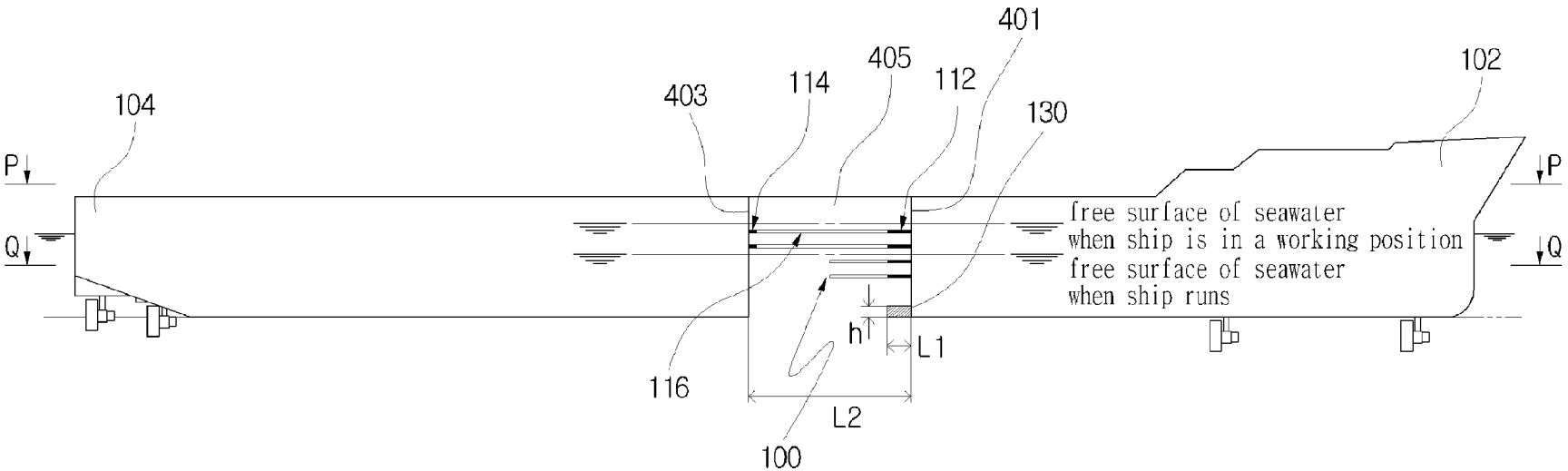
FIG. 1 is a side sectional view of a ship having an anti-sloshing moon pool structure according to a first embodiment of the present invention.
Figure 2:
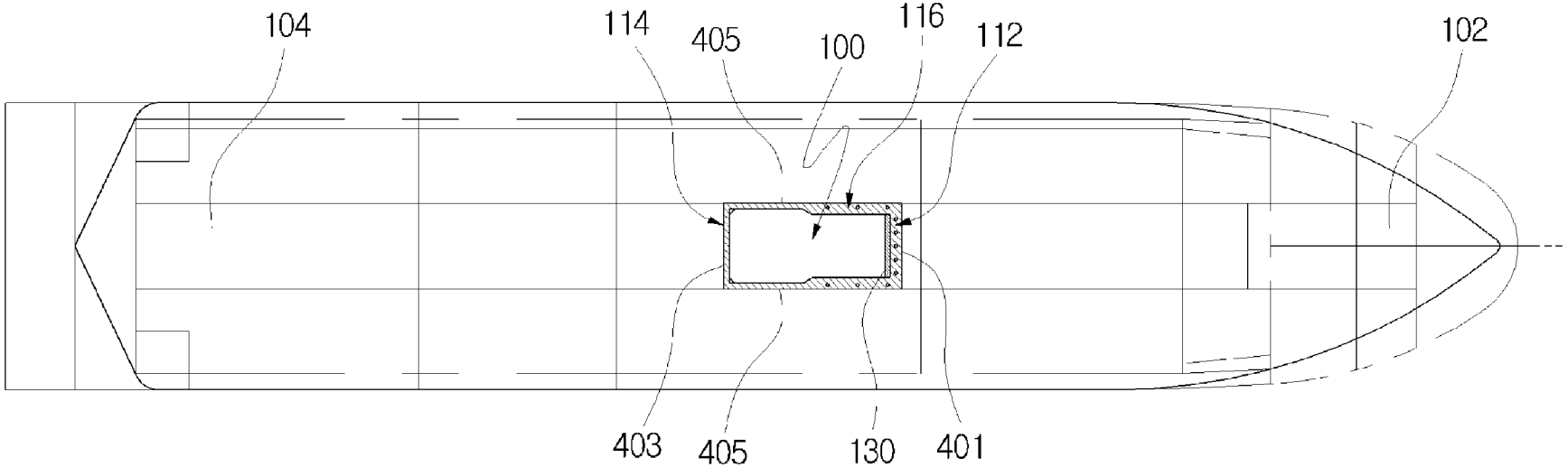
FIG. 2 is a plan sectional view taken along line P-P of FIG. 1.
Figure 3:
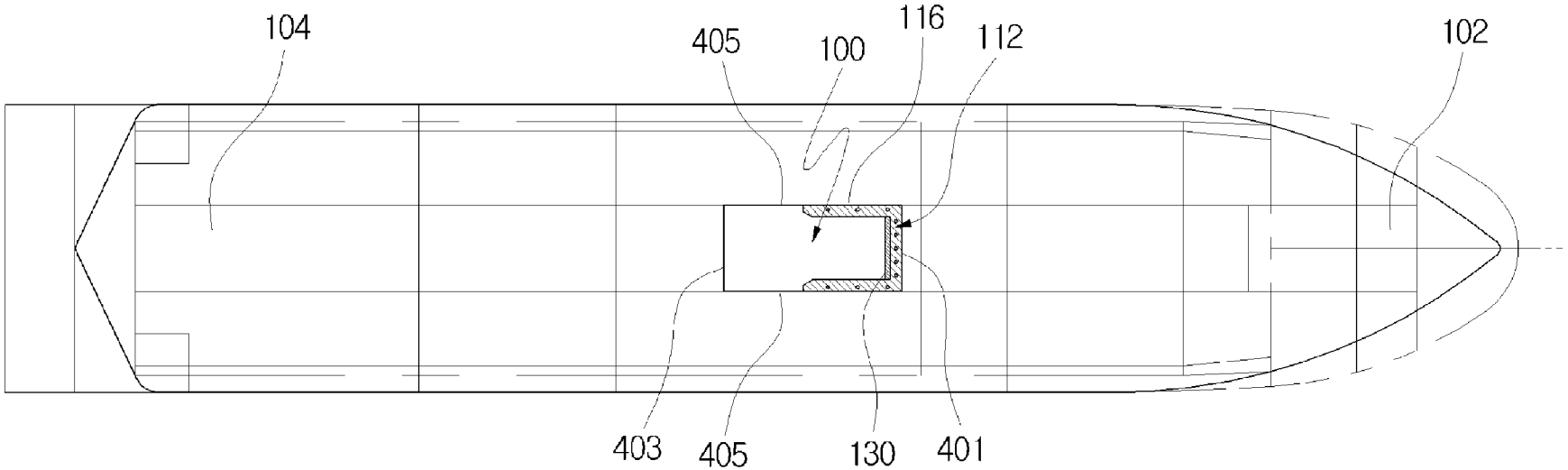
FIG. 3 is a plan sectional view taken along line Q-Q of FIG. 1.
Figure 4:
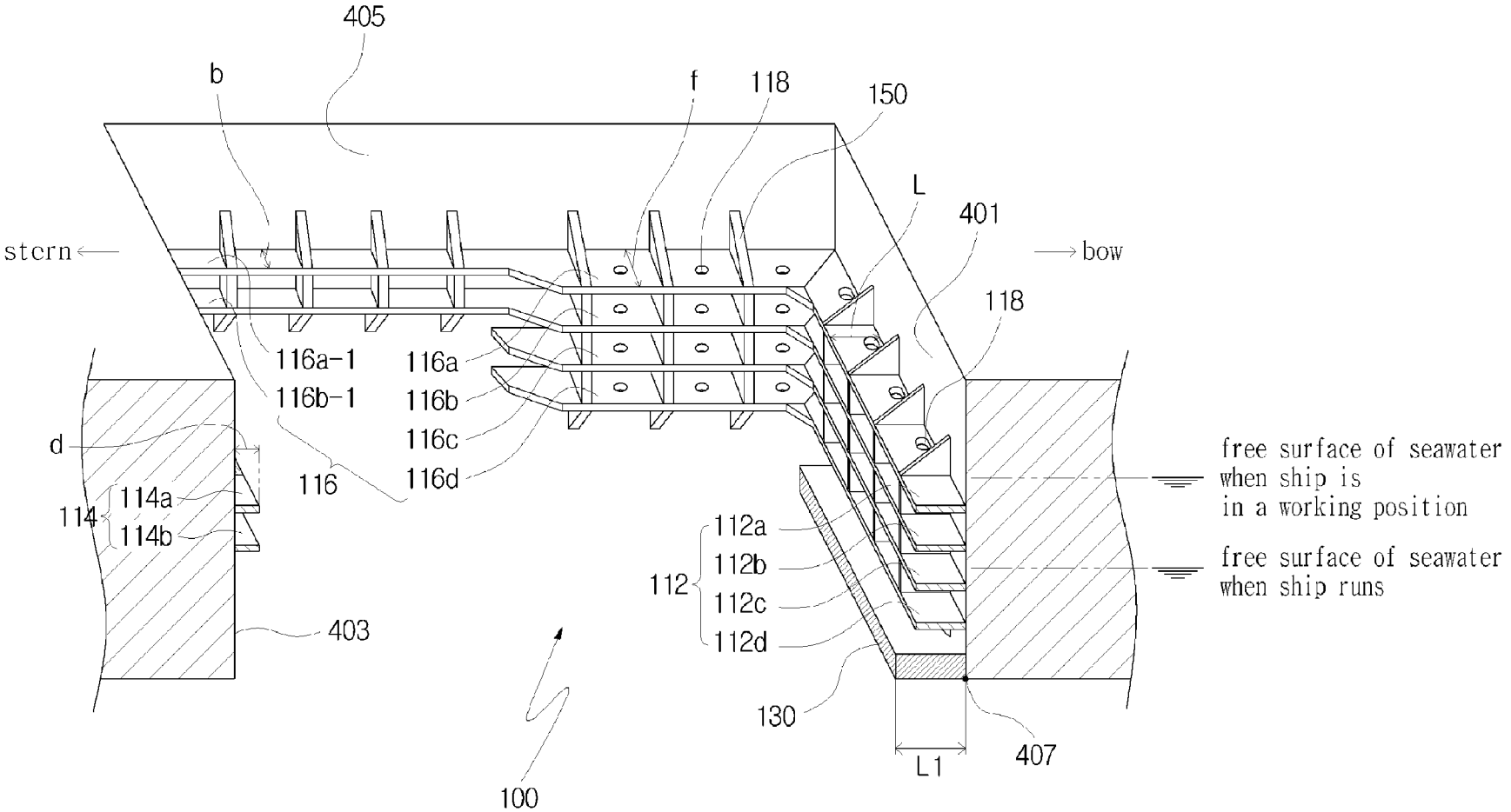
FIG. 4 is a perspective view showing part of the first embodiment of FIG. 1.

FIG. 1 is a side sectional view of a ship having an anti-sloshing moon pool structure according to a first embodiment of the present invention. FIG. 2 is a plan sectional view taken along line P-P of FIG. 1. FIG. 3 is a plan sectional view taken along line Q-Q of FIG. 1. FIG. 4 is a perspective view showing part of the first embodiment of FIG. 1.

As shown in FIG. 1, according to the position in the ship, the ship having the anti-sloshing moon pool structure according to the present invention is sectioned into a bow part 102, which forms the front part of the ship, a stern part 104, which forms the rear part of the ship, and a moon pool 100, which is formed between the bow part 102 and the stern part 104.

The moon pool 100 is vertically formed through the ship, that is, from the top of the ship to the bottom thereof, and serves as a passage through which a drilling machine and a drilling pipe are passed to the bottom of the sea.

The anti-sloshing moon pool structure of the present invention includes moon pool plates 112, 114 and 116, which dampen the sloshing motion of fluid, that is, the periodic motion of seawater drawn into the moon pool 100, and a moon pool bottom block 130, which prevents water, flowing along the lower surface of the ship, from whirling in the moon pool 100.

The moon pool plates 112, 114 and 116, which constitute the anti-sloshing moon pool structure, are perpendicularly attached to a bow-side wall 401, a stern-side wall 403 and opposite sidewalls 405, which define the inner walls of the moon pool 100.

The moon pool plates 112, 114 and 116 are classified into bow-side moon pool plates 112, stern-side moon pool plates 114 and sidewall moon pool plates 116, according to the position of the inner wall of the moon pool 100 corresponding thereto.

Referring to FIGS. 1, 2 and 4, several upper steps 112*a*, 112*b*, 114*a*, 114*b*, 116*a*, 116*a*-1, 116*b* and 116*b*-1 of the moon pool plates 112, 114 and 116 are provided such that, when the ship is in a working position, they are lower than the free surface of the seawater. Here, the upper steps 112*a*, 112*b*, 114*a*, 114*b*, 116*a*, 116*a*-1, 116*b* and 116*b*-1 are provided at corresponding positions on the bow-side wall 401, the stern-side wall 403 and the opposite sidewalls 405.

The term "working position" indicates the position of the ship when a drilling process or a process of constructing an undersea structure is conducted.

On the other side, several lower steps 112*c*, 112*d*, 116*c* and 116*d* of the moon pool plates 112, 114 and 116 are provided such that they are lower than the free surface of the seawater when the ship runs. Here, the lower steps 112*c*, 112*d*, 116*c* and 116*d* are disposed at corresponding positions on the bow-side wall 401 and on only portions of the opposite sidewalls 405 which are adjacent to the bow-side part of the moon pool.

This is clearly understood when reference is made to FIGS. 2 and 3.

FIG. 2 is a plan view showing the upper steps of the moon pool plates 112, 114 and 116. FIG. 3 is a bottom view showing the lower ends of the moon pool plates 112 and 116, which have an area less than that of the upper steps thereof.

In detail, as shown in FIG. 4, in consideration of drilling equipment, lengths (L, d, b and f, see, FIG. 4) that the moon pool plates 112, 114 and 116 protrude are different from each other, or the moon pool plates 112, 114 and 116 have shapes in which parts thereof are omitted.

The protruding length (L) of each bow-side moon pool plate 112 is greater than the protruding length (d) of each stern-side moon pool plate 114. Furthermore, in the sidewall moon pool plates 116, the protruding length (b) of each of the stern-side upper steps 116*a*-1 and 116*b*-1 is less than the protruding length (f) of each of the bow-side upper steps 116*a* and 116*b* and the bow-side lower steps 116*c* and 116*b*.

As such, because the plates have different sizes, when the drilling work is conducted, the drilling equipment, including the drilling machine or the drilling pipes that pass through the moon pool 100, are movable, and the moon pool plates 112, 114 and 116 can exhibit an anti-sloshing effect in the moon pool 100 without interfering with the drilling equipment.

Furthermore, the number of layers of steps of the bow-side moon pool plates 112 is greater than the number of steps of the stern-side moon pool plates 114. The number of steps of the stern parts of the sidewall moon pool plates 116 is less than that of the bow parts of the sidewall moon pool plates 116.

The reason why the numbers of steps of the moon pool plates 112, 114 and 116 are different is as follows. Because the maximum working area, within which the drilling equipment, including the drilling machine and the drilling pipes, which pass through the moon pool 100, is movable, is increased from the deck of the ship to the bottom thereof, the numbers of steps of the moon pool plates 112, 114 and 116 must vary in order to prevent the moon pool from interfering with the drilling equipment when the drilling work is conducted.

In the additional description, no plate is provided on the lower portion of the stern part of the moon pool 100 to prevent the stern-side moon pool plate 114 from interfering with the maximum working area of the drilling equipment when leaning towards the stern part of the moon pool 100.

In other words, to respond to the case where a worktable of a main drill, which is installed on the deck of the ship, is disposed at a position adjacent to the stern part of the moon pool, the moon pool plates 112, 114 and 116 are formed into the above-mentioned shape.

Furthermore, as another embodiment (not shown), the moon pool plates may have a construction opposite the above-mentioned construction in order to respond to the case where the worktable of the main drill is disposed at a position adjacent to the bow part. In detail, in the case where the maximum working area of the drilling equipment leans towards the bow part of the moon pool 100 in a manner opposite to that of FIG. 4, the moon pool plates may be constructed such that the protruding length of the bow-side moon pool plate is less than that of the stern-side moon pool plate, and the protruding length of the stern part of each sidewall moon pool plate is greater than that of the bow part thereof.

Furthermore, a plurality of moon pool plate supports 150 is provided in the moon pool plates 112, 114 and 116 to reliably fasten the moon pool plates to the inner walls of the moon pool 100, that is, to the bow-side wall 401, the stern-side wall 403 and the opposite sidewalls 405.

In addition, moon pool plate holes 118 are formed through the moon pool plates 112 and 116, so that some of the fluid that strikes the moon pool plates 112 and 116 passes therethrough.

The moon pool plate holes 118 mitigate the striking force of fluid in the moon pool 100, thus preventing excessive striking force from being applied from fluid to the moon pool plates.

As such, the moon pool plates 112, 114 and 116, which are installed on the inner walls of the moon pool 100, serve to restrain the sloshing motion of fluid drawn into the moon pool 100.

In detail, typically, the ship undergoes periodic motion depending on the sea conditions (for example, waves, wind, tidal current, etc.). Here, when the period of motion of the ship differs from that of the fluid drawn into the moon pool 100, a phase difference occurs between the ship and the fluid in the moon pool 100.

Due to the phase difference, the fluid in the moon pool 100 may overflow onto the deck of the ship. In the present invention, the moon pool plates 112, 114 and 116 absorb some of the kinetic energy of fluid that moves in the moon pool 100 forwards, rearwards, upwards and downwards, thus restraining the sloshing motion of fluid, thereby preventing fluid in the moon pool 100 from overflowing onto the deck of the ship.

The moon pool bottom block 130, which constitutes the anti-sloshing moon pool structure, is attached to a bow-side lower edge 407 of the inner walls of the moon pool 100 in a direction toward the center of the moon pool 100. It is preferable that the moon pool bottom block 130 be level with the lower surface of the ship.

The protruding length (L1) of the moon pool bottom block 130 is greater than 0% of the longitudinal length (L2) of the moon pool 100 and is 20% thereof or less, as shown in FIG. 1. Furthermore, the height (h) of the moon pool bottom block 130 is the same as that of the double-ply bottom of the ship.

Thanks to the structure in which the height (h) of the moon pool bottom block 130 is the same as that of the double-ply bottom of the ship, the workability and productivity, when constructing the ship, are enhanced. Here, the term "height of the double-ply bottom" indicates the distance between an outer panel and an inner panel of the double ship body.

Typically, when the ship having the moon pool travels, fluid, which flows along the lower surface of the ship, is scattered around the bow-side lower edge 407 of the inner walls of the moon pool 100. Due to this, a vortex is generated in the moon pool 100. This vortex, generated in the moon pool 100, reduces the velocity of the ship when it runs. Therefore, to increase the velocity of the ship, it is necessary to minimize the generation of the vortex. The moon pool bottom block 130 conducts the required function.

That is, the moon pool bottom block 130 maximally moves a position, at which fluid is scattered around the bow-side lower edge 407 of the inner walls of the moon pool 100, towards the stern-side part of the ship, thus minimizing the generation of the vortex in the moon pool 100.

Second Embodiment

An anti-sloshing moon pool structure according to the second embodiment of the present invention has a technical spirit equal to or similar to that of the first embodiment, other than that it is constructed such that the protruding length of the moon pool plates is reduced from the top of the ship to the bottom thereof so that the maximum working area is extended towards the bottom of the ship. Therefore, the same reference numerals are used throughout the different drawings to designate the same or similar components in FIGS. 1 through 7. Furthermore, an explanation of these components will be omitted.

Figure 5:
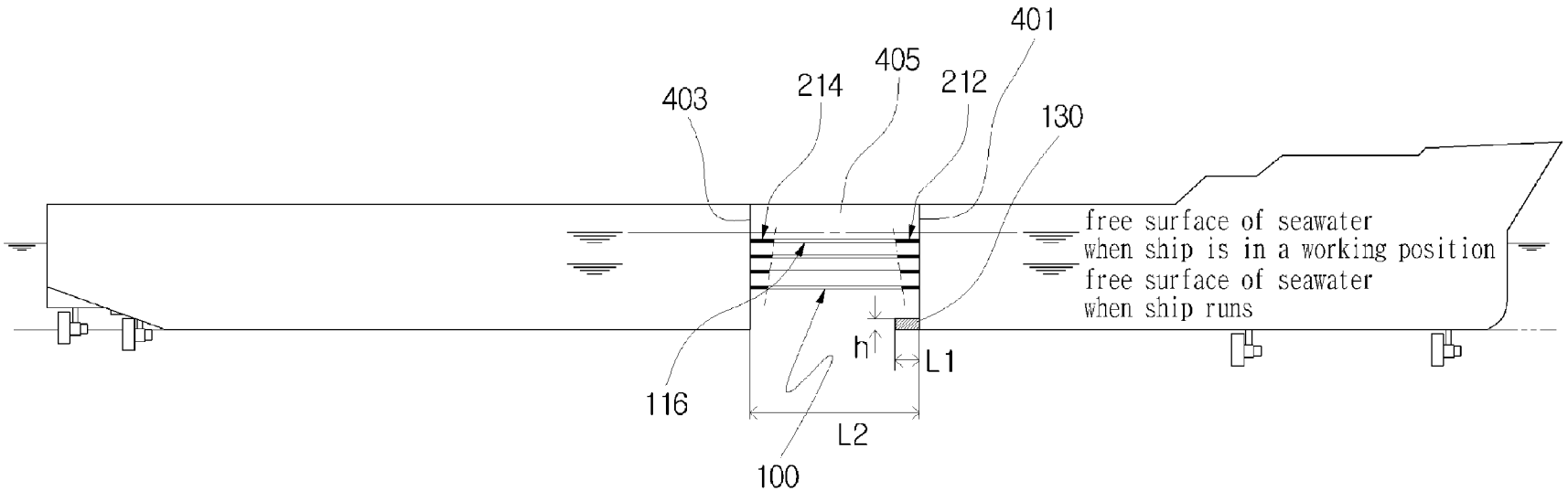
FIG. 5 is a side sectional view of a ship having an anti-sloshing moon pool structure according to a second embodiment of the present invention.
Figure 6:
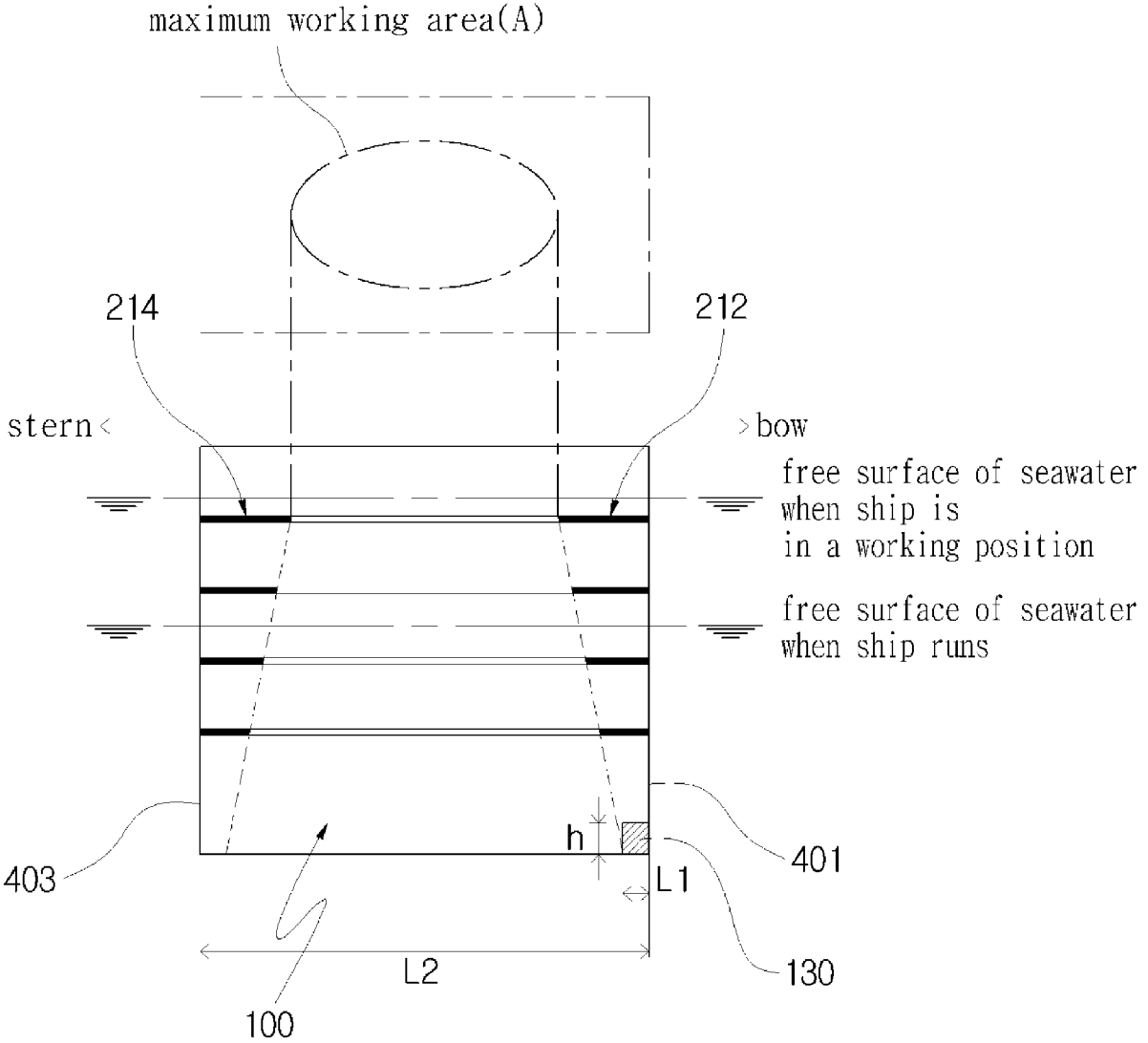
FIG. 6 is a side sectional view showing an enlargement of the second embodiment of FIG. 5.

As shown in FIGS. 5 and 6, several respective moon pool plates 212, 214 and 216 are perpendicularly attached to a bow-side wall 401, a stern-side wall 403 and opposite sidewalls 405 from the top of the ship to the bottom thereof at positions spaced apart from each other at predetermined intervals in the height direction of the ship.

Referring to FIG. 6, the term "maximum working area (A)" denotes the maximum area of the moon pool, within which the drilling equipment, including the drilling machine and the drilling pipes, which pass through the moon pool 100, are movable without being brought into contact with the moon pool 100 when the drilling operation is conducted. The maximum working area is increased in diameter or in cross-sectional area from the deck of the ship to the bottom thereof, thus defining a range having a circular or rectangular frustoconical shape.

Figure 7:
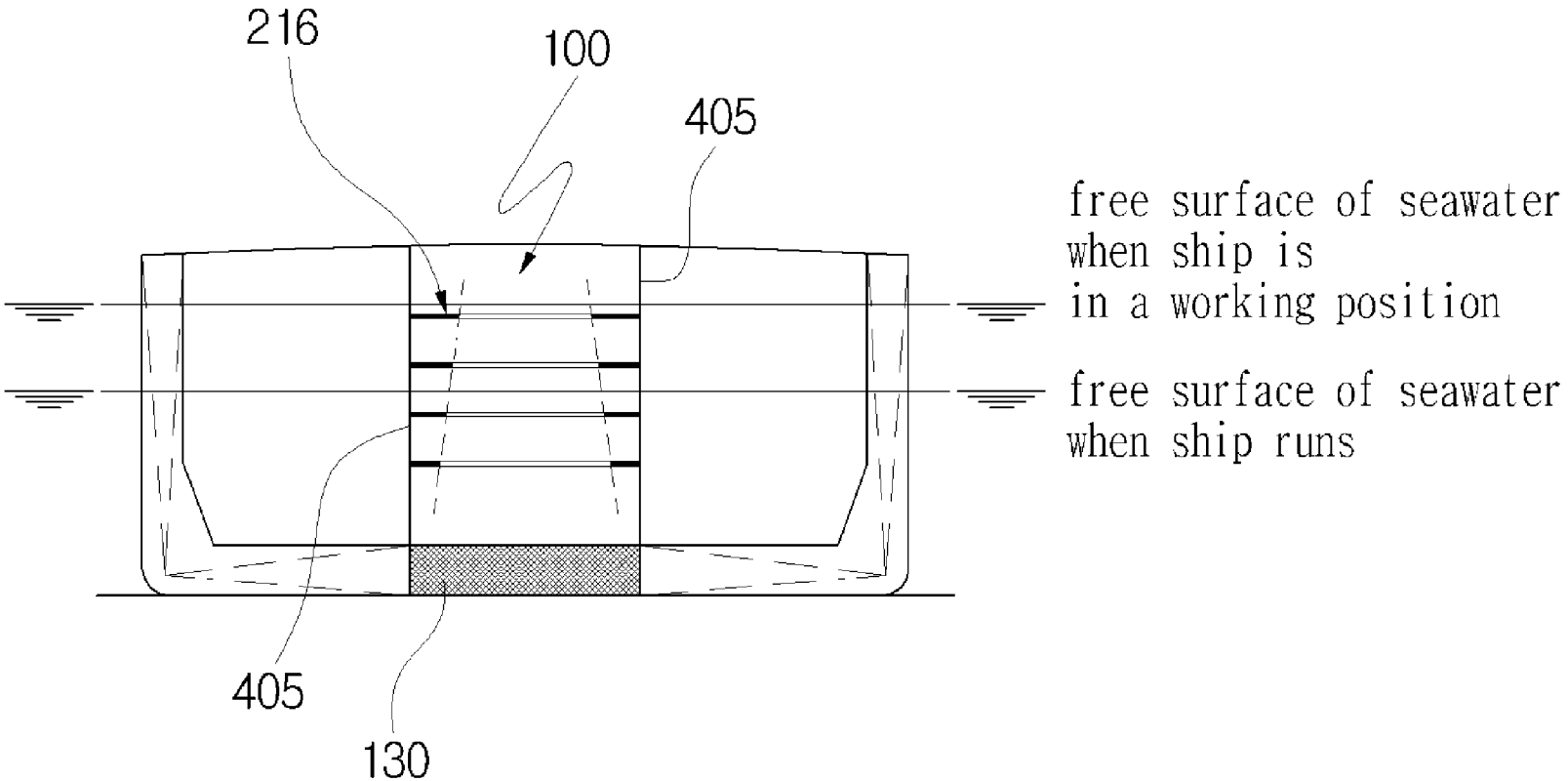
FIG. 7 is a transverse sectional view of the ship of the second embodiment shown in FIG. 5.

As shown in FIGS. 5 through 7, the numbers of layers or steps of the moon pool plates 212, 214 and 216 are equal to each other in order to efficiently restrain the sloshing motion of fluid in the moon pool 100 within a range within which the moon pool plates 212, 214 and 216 do not interfere with the maximum working area (A).

Furthermore, the moon pool plates 212, 214 and 216 may be constructed such that the protruding lengths of the moon pool plates 212, 214 and 216 are different from each other or are asymmetrical based on the center of the moon pool, in consideration of the drilling operation, which is mainly conducted adjacent to the stern part of the moon pool 100.

Meanwhile, the preferred embodiments of the present invention, which have been explained in the specification with reference to the attached drawings, are only illustrative examples, and do not set the bounds of the present invention. Furthermore, in addition to the disclosed embodiments, those skilled in the art will appreciate that various modifications, additions and substitutions are possible, without departing from the scope and spirit of the invention.

INDUSTRIAL APPLICABILITY

As described above, the anti-sloshing moon pool structure according to the present invention is expected to be widely used in the shipbuilding industry, including the manufacture of drill ships that are able to make voyages under their own power and are provided with drilling equipment.

The invention claimed is:

1. An anti-sloshing moon pool structure, comprising:

a plurality of moon pool plates (112, 114, 116, 212, 214, 216) perpendicularly provided on a bow-side wall (401), a stern-side wall (403) and opposite sidewalls (405) of inner walls of a moon pool (100); and a moon pool bottom block (130) provided on a bow-side lower edge (407) of the inner walls of the moon pool (100) in a direction oriented toward a center of the moon pool (100), wherein the moon pool plates and the moon pool bottom block (130) have protruding lengths within which the moon pool plates and the moon pool bottom block do not interfere with a maximum working area, a plurality of upper steps (112*a*, 112*b*, 114*a*, 114*b*, 116*a*, 116*a*-1, 116*b* and 116*b*-1) of the moon pool plates is disposed such that, when a ship is in a working position, the plurality of upper steps is lower than a free surface of seawater, and a plurality of lower steps (112*c*, 112*d*, 116*c* and 116*d*) of the moon pool plates is disposed such that, when the ship runs, the plurality of lower steps is lower than the free surface of the seawater, wherein protruding lengths of the moon pool plates are reduced from a top of the ship to a bottom of the ship.

2. The anti-sloshing moon pool structure according to claim 1, wherein the moon pool plates have a same protruding length at a bow side, a stern-side and sidewalls of the moon pool.

3. The anti-sloshing moon pool structure according to any one of claims 1 through 2, further comprising:

a plurality of moon pool plate supports (150) provided in the moon pool plates to fasten the moon pool plates to the inner walls of the moon pool.

4. The anti-sloshing moon pool structure according to any one of claims 1 through 2, wherein the protruding length (L1) of the moon pool bottom block is greater than 0% of a longitudinal length (L2) of the moon pool and is 20% or less of the longitudinal length (L2) of the moon pool.

5. The anti-sloshing moon pool structure according to any one of claims 1 through 2, wherein, of the moon pool plates, a protruding length (L) of each of bow-side moon pool plates (112) is greater than a protruding length (d) of each of stern-side moon pool plates (114), and a protruding length (b) of each of stern-side upper steps (116*a*-1) and (116*b*-1) of sidewall moon pool plates (116) is less than a protruding length (f) of each of bow-side upper steps (116*a*) and (116*b*) and bow-side lower steps (116*c*) and (116*d*) of the sidewall moon pool plates (116).

6. The anti-sloshing moon pool structure according to claim 5, wherein moon pool plate holes (118) are formed through the bow-side upper steps (116*a*) and (116*b*) and the bow-side lower steps (116*c*) and (116*d*) of the sidewall moon pool plates (116) and through the bow-side moon pool plates (112) to mitigate force of fluid striking the moon pool (100).

7. The anti-sloshing moon pool structure according to any one of claims 1 through 2, wherein, of the moon pool plates, a number of layers of the bow-side moon pool plates (112) is greater than a number of layers of the stern-side moon pool plates (114), and a number of layers of stern-side sidewall moon pool plates (116) is less than a number of layers of bow-side sidewall moon pool plates (116).

8. The anti-sloshing moon pool structure according to any one of claims 1 through 2, wherein a height (h) of the moon pool bottom block is equal to a height of the double-ply bottom of the ship.

* * * * *